United States Patent [19]

Pardo et al.

[11] Patent Number: 4,818,116

[45] Date of Patent: Apr. 4, 1989

[54] FOOD PROCESS AGITATOR

[75] Inventors: Warren A. Pardo, Bel Air; Richard J. Pardo; Valentino Gabriele, both of Baltimore, all of Md.

[73] Assignee: J. C. Pardo and Sons, Inc., Baltimore, Md.

[21] Appl. No.: 125,576

[22] Filed: Nov. 25, 1987

Related U.S. Application Data

[62] Division of Ser. No. 907,001, Sep. 15, 1986.

[51] Int. Cl.[4] ..... B01F 7/02

[52] U.S. Cl. ..... 366/311; 15/246.5; 99/348; 366/312

[58] Field of Search ..... 99/348; 366/279, 309, 366/311, 312, 313, 326, 65, 67; 15/246.5 X

[56] References Cited

U.S. PATENT DOCUMENTS

| | | | |
|---|---|---|---|
| 2,513,254 | 6/1950 | Savage et al. | 99/348 |
| 3,752,057 | 8/1973 | Groen, Jr. | 366/312 |
| 4,095,307 | 6/1978 | Brubaker | 366/311 |
| 4,571,091 | 2/1986 | Pardo et al. | 366/311 |

*Primary Examiner*—Harvey C. Hornsby
*Assistant Examiner*—Corinne M. Reinckens
*Attorney, Agent, or Firm*—Kenneth E. Darnell

[57] ABSTRACT

An agitator for mixing food or other materials in a kettle either with or without heating of the materials, the invention allows gentle and thorough mixing of materials ranging from liquids to semi-solids. The present agitator is especially usefual, for mixing and blending of substantially liquid mixtures having suspended solids, the solids being uniformly suspended within the mixture without damage to the solids. The agitator preferably takes the form of a rotary shaft horizontally disposed within a kettle having a substantially hemispherical bottom portion, each end of the shaft having a substantially arcuate element of particular contour attached thereto. The arcuate elements lie in planes which are perpendicular to each other and are the same general shape. The arcuate elements are provided with contoured scrapers having scraping edges which conform to localized portions of the interior surface of the kettle and which in combination act to uniformly scrape food-contacting walls of the kettle to prevent burn-on of food materials during a mixing and/or cooking period. The scrapers and to some degree the arcuate elements act on rotation of the shaft to lift material from the bottom of the kettle to the top of the body of the material and thus produce a uniform dispersion of liquid and solid materials during cooking/mixing, during mixing only, or while dispensing the uniformly mixed material from the kettle.

8 Claims, 7 Drawing Sheets

FOOD PROCESS AGITATOR

This is a divisional of copending application Ser. No. 907,001, filed Sept. 15, 1986.

BACKGROUND OF THE INVENTION

1. Field of the Invention

The invention relates to the mixing of materials such as foods and particularly to foods which are shear sensitive, thereby to prevent damage to the foods and to maintain the organoleptic and visual qualities of the food.

2. Description of the Prior Art

Large scale cooking of food such as is necessary in an institutional situation and the like has long been accomplished in large cooking kettles, cooking or heating of foodstuffs in such kettles often requiring stirring or mixing operations which occur while the foodstuffs are being heated or cooked. Since mixing or stirring by hand is unreasonably laborious even in the smaller kettles used in hotels, restaurants, health care facilities and the like, the use of power driven mixers has long been known. Such mixers often take the form of structural elements which merely stir a food or other material which is to be mixed either with or without cooking or heating. Conventional mixing agitators also exist which not only mix food materials being cooked or heated in a kettle, but also scrape the surfaces of the kettle which contact the food materials to prevent the sticking of overheated food material to surfaces of the kettle which can occur due to localized overheating of the food materials which simple stirring often cannot prevent. Accordingly, mixing agitators having scraper elements which contact food-contacting surfaces of cooking kettles have previously been provided in the art, such mixers acting not only to scrape the walls of the kettle to displace food materials positioned adjacent the walls but which also act to mix and blend the remaining portions of the body of the food materials.

Mixing agitators having scraping capability are disclosed by Groen, Jr. in U.S. Pat. No. 3,752,057, this patent describing a mixer having a shaft-which extends into a kettle at an angle of at least 20° with respect to the vertical axis of the kettle. The shaft of Groen, Jr. is provided with a hoop-like structure at the distal end of the shaft, the hoop-like structure having a plurality of scrapers pivotally mounted to said structure at differing inclinations to the axis of the shaft, the scrapers acting to contact surface portions of the kettle in order to prevent food "burn-on" when a food material is being heated within a cooking kettle.

Giusti, in U.S. Pat. No. 4,199,266, describes a mixing agitator having a scraping capability wherein a rotary shaft is disposed horizontally within a cooking kettle, the shaft having a substantially circular agitator mounted thereon and wherein the agitator is formed of a pair of substantially annular semicircular blades each having an internal segment-shaped web. The annular blades each carry a plurality of scrapers at their respective periperhies for scraping of internal surfaces of a kettle.

Both the Groen, Jr. and Giusti patents act to move cooking foods from the bottom of the kettle at which location the greatest amount of heat is being directed into the cooking material and lift the food material to the vicinity of the upper most portion of the body of the food material, thereby giving that food material near the top of the kettle a chance to flow downwardly and into contact with the heated surfaces of the kettle at the bottom of the kettle. A mixing and blending of the material thus occurs with the scraping of the walls of the kettle being intended to assure that no portion of the food material remains near the cooking surfaces for a time sufficient to cause overheating of portions of the food material.

Examples of other mixing agitators, some of which include scraping elements, are disclosed by Rebechini in U.S. Pat. No. 2,753,158; Hirshon in U.S. Pat. No. 2,580,780; Costa et al in U.S. Pat. No. 3,739,710; and Addision in U.S. Pat. No. 3,731,339. With the exception of the Costa et al patent, the mixers described above do not employ agitators having a vertical axis since such vertical axis agitators must function at high speed to effectively mix certain foods which consist of solid pieces in a liquid base. Operation of such mixers at high speed exerts a substantial shearing effect on the solid materials in such a mixture, thereby resulting in fragmentation and damage-to such solid pieces when the solid pieces are of a shear sensitive nature. Accordingly, in many food mixing situations, mixing at a low speed is necessary in order to prevent physical degradation of the food. A gentle lifting of food materials near the bottom of a cooking kettle is thus required in order to prevent damage to shear sensitive food materials in a mixture which is either being simply mixed or mixed during a cooking or heating process. While mixing agitators having a scraping capability have been previously utilized in the art as indicated above, such mixing agitators have been intended to be "universal" in operation, that is, the prior agitators have been intended to be useful in a wide range of applications as diverse as food processing, chemical processing cosmetics mixing, pharmaceutical processing and the like. The mixing requirements of these diverse applications can be quite different. Accordingly, agitator structures designed to function in a number of these various applications typically are not well adapted for optimum usage in all of the different applications. and may only be barely adequate for any specific mixing application The present mixing agitator and scraper assembly is primarily designed for use in food processing and is intended for use in the mixing of foods which are being cooked or heated in a kettle such as a steam-jacketed kettle with the foods either having a water base or roux base with thickeners. The scraping capability of the present mixing agitator is particularly necessary for the roux-base materials to prevent "burn-on" during cooking. While the present mixing agitator can be employed in fields other than food processing with performance at least equal to most commercially available agitators, the present mixing agitator finds particular utility in the food processing field and allows extremely thorough and gentle mixing of food materials including scraping of the containing kettle. The present agitator and scraper assembly is a relatively simple and inexpensive structure which can be rapidly assembled and disassembled without the use of tools, thus facilitating cleaning of the agitator and kettle and reducing the time required between cooking of different materials within the same kettle. Accordingly, the present invention provides a mixing agitator having a scraping capability and which provides performance, operational and cost advantages over agitators of the prior art.

SUMMARY OF THE INVENTION

The present invention provides a mixing/scraping agitator particularly intended for use in the food processing arts and which is primarily intended for use in a cooking or mixing kettle having a substantially hemispherical lower portion. Such kettles when used for cooking or heating of a food material typically have a constant radius in the hemispherical portion which is intended to contain the food materials being heated or cooked. These kettles are usually provided with a steam jacket for introducing heat to the materials which are to be cooked or heated. The present agitator is primarily useful with kettles used for heating and cooking, the scraping capability of the present agitator being particularly important in heating/cooking process situations. The scraping elements of the present agitator also provide a gentle lifting, folding and blending of food materials including shear sensitive materials in both heating-/cooking process situations as well as in situations requiring only simple mixing and blending.

The present mixing agitator is mounted within a kettle with the longitudinal axis of its rotating shaft disposed horizontally, the shaft carrying an arcuate mixing element at each end with the mixing elements each differing slightly in structure from the other and being shaped and configured to complement the function of the other mixing element. Scraper elements are mounted to each of the arcuate mixing elements and are arranged to "trail" the mixing elements on rotation of the shaft. The scraper elements are spring-loaded to provide positive contact between arcuate scraping edges of the scraper elements and food-contacting walls of the kettle. A single rotation of the agitator scrapes the entire wall surface of the hemispherical or food-contacting portions of a kettle over which localized heating can occur due to the presence of a steam jacket or the like. In addition to the scraping function, the present agitator is capable of gently lifting shear-sensitive food materials from lower portions of a kettle to upper portions of the food mass without damaging the food or reducing the organoleptic and visual qualities of the food. The present agitator is preferably hydraulically driven to allow continuous torque at variable speeds and to further allow the agitator to be conveniently driven within a speed range of 3 rpms to 30 rpms depending upon the exigencies of a particular mixing application.

The present mixing agitator is further provided with a quick-disconnect shaft arrangement which requires only a single stuffing box and active bearing arrangement at one end, the shaft at the active end being a split shaft capable of being disconnected through a pin and coupling arrangement to allow disassembly of the agitator from the kettle without tools. The other end of the shaft mounts to a stub shaft attached to the wall of the kettle. The agitator can thus be rapidly removed from the kettle without the use of tools for thorough cleaning of the agitator and kettle with a minimum of down-time between separate cooking operations.

The present agitator and scraper assembly provides uniform scraping of kettle walls and also acts to uniformly stir and mix food by gently bringing food materials up from the bottom of the kettle to the top, thereby guaranteeing a uniform dispersion of food materials, particularly solid materials within a liquid base, to yield a uniform product at the end of a cooking and/or mixing operation. For food materials which are not shear sensitive, the present agitator can be driven at speeds which produce more aggressive mixing. However, a particular advantage of the present structure is the ability to provide uniform scraping of kettle walls to prevent overheating of food being cooked within a kettle and also thorough and uniform mixing at low speeds to yield a gentle folding action which prevents or reduces damage to solids due to mechanical shear which is often encountered in foods having shear-sensitive food components such as meats, seafood, vegetables, pasta or fruits.

It is therefore an object of the invention to provide a mixing agitator used with a kettle and having a scraping capability and which is capable of uniform scraping of kettle walls while completely and thoroughly mixing shear-sensitive food materials without degradation of the food.

It is another object of the present invention to provide a mixing agitator and scraping assembly particularly useful in the food processing industry and which includes a horizontally disposed rotary shaft having arcuate mixing elements at the ends of the shaft with scraper elements being mounted to the arcuate mixing elements and being capable of continuous adjustment to accommodate wear and the like to maintain scraping of surfaces in contact with food contacting walls of the kettle during cooking or heating of foodstuffs having thickeners or other materials which locally overheat when adjacent to heated kettle surfaces if not periodically removed from the vicinity of the heated kettle surfaces.

It is yet another object of the present invention to provide a mixing agitator and scraping assembly horizontally mounted within a kettle and which includes a split shaft and stub shaft arrangement allowing rapid assembly and disassembly of the agitator to facilitate cleaning of the assembly and kettle within which the assembly is mounted.

It is a further object of the present invention to provide a mixing agitator and scraping assembly capable of particular use in the processing of food and which is capable of both gentle and aggressive mixing of food materials while scraping interior food-contacting surfaces of a kettle within which food is being processed.

Further objects and advantages of the invention will become more readily apparent in light of the following detailed description of the preferred embodiments.

DESCRIPTION OF THE PREFERRED EMBODIMENTS

The disclosure of U.S. Pat. No. 4,571,091, issued Feb. 18, 1986, is incorporated hereinto by reference.

Figure 1:
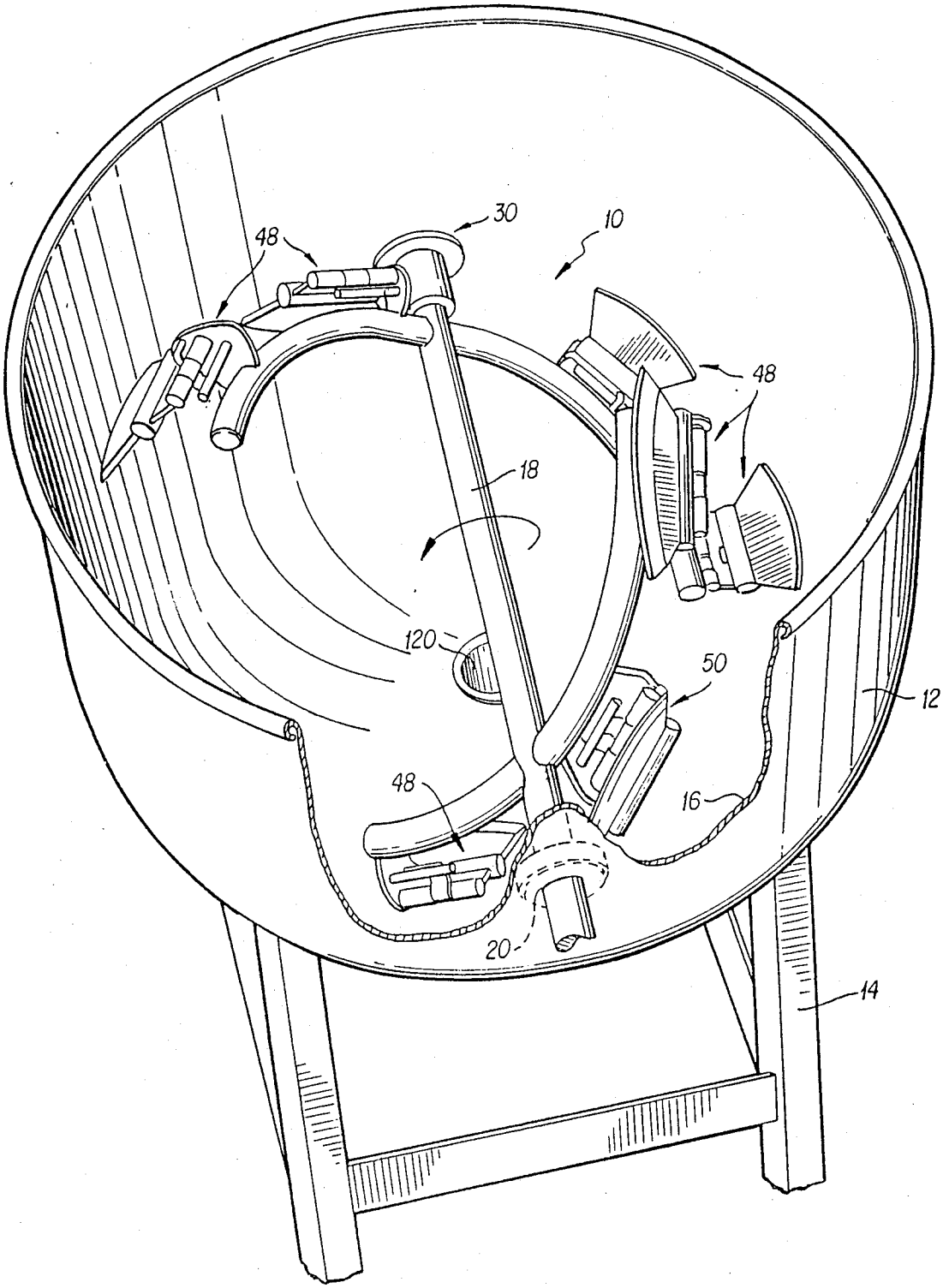
FIG. 1 is a perspective view partially cutaway illustrating the mounting of the present agitator within a kettle.

Referring now to the drawings and particularly to FIG. 1, a mixing agitator 10 configured according to a preferred embodiment of the invention is shown to be disposed within a conventional kettle 12 for mixing of materials (not shown) which are held within the kettle. The kettle 12 can be provided with a steam-jacket (not shown in FIG. 1) and supporting structure 14 of a conventional nature, the steam jacket not being shown for convenience of illustration. However, reference is made to FIG. 16 which shows a conventional steam jacket as will be referred to relative to FIG. 16. The kettle 12 is seen to have a hemispherical bottom portion as is conventional in the art, inner walls 16 of the hemispherical portion constituting primary heating surfaces within which food or other materials are brought into contact during a heating or cooking operation occurring within the kettle 12. As will be described in detail hereinafter, the inner walls 16 of the kettle 12 are scraped by portions of the agitator 10 to prevent sticking of food to the walls 16 due to localized overheating.

The agitator 10 is seen to comprise a rotary shaft 18 which is horizontally mounted within the kettle 12, one end of the shaft 18 being releasably carried by an idler or toe bearing 20. The other end of the shaft is formed with a split shaft 26 which comprises a portion of a split shaft arrangement connected to bearings externally of the kettle as is described in U.S. Pat. No. 4,571,091. The structure and function of apparatus essentially identical to the toe bearing 20 and the split shaft arrangement which includes the split shaft 26 is provided in U.S. Pat. No. 4,571,091 relative to the mounting within a kettle of an agitator having a horizontal shaft. The mounting structure thus described in U.S. Pat. No. 4,571,091 can be used to mount the present agitator 10 in the kettle 12 for rotary operation.

As can best be seen in FIGS. 2 and 3, the rotary shaft 18 is provided at one end with a recess 22 which receives the toe bearing 20 as noted above, that end of the rotary shaft 18 having the recess 22 being hereinafter referred to as the "recessed end" 24. For purposes of description of the shaft 18, the end of the shaft 18 which is formed into the split shaft 26 will be referred to as "split shaft end" 30.

Figure 2:
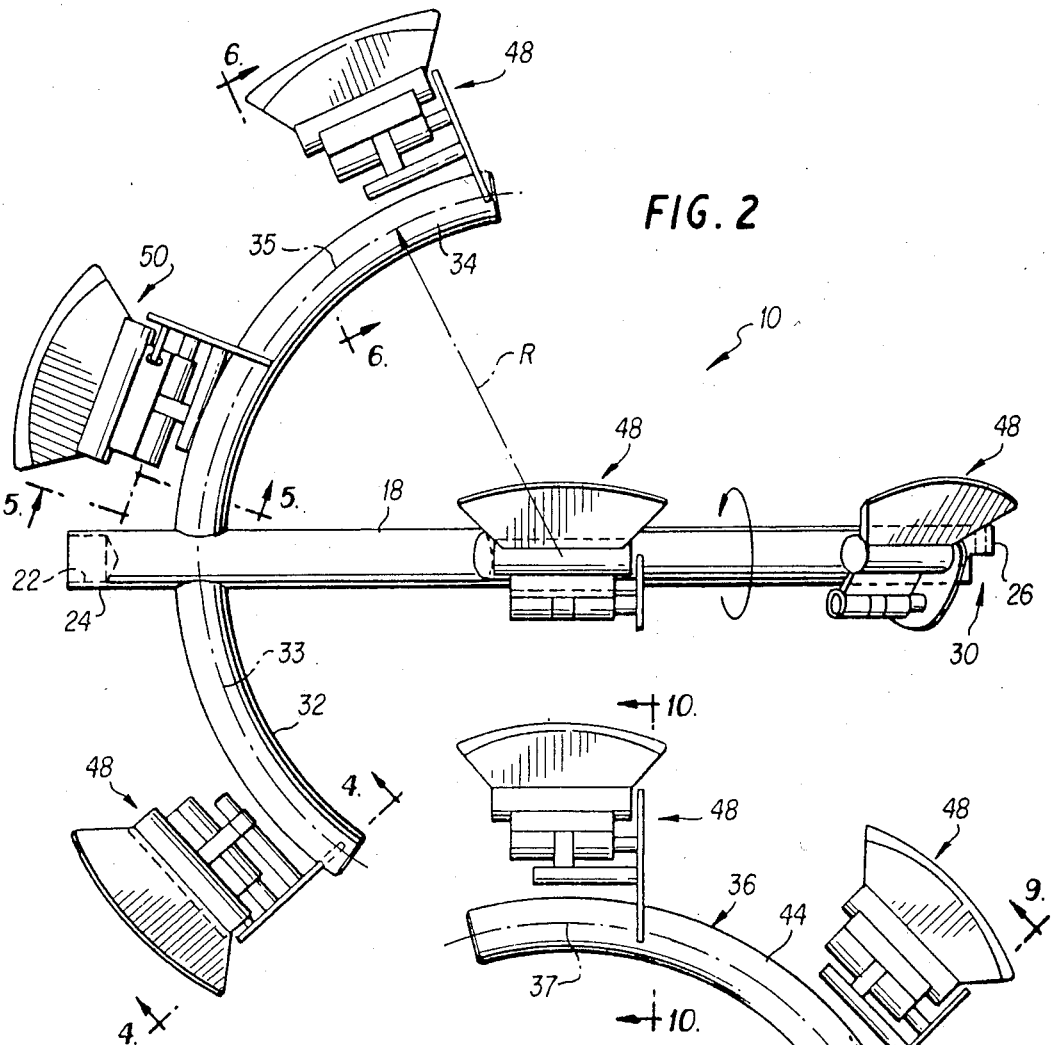
FIG. 2 is an elevational view of the present agitator.
Figure 3:
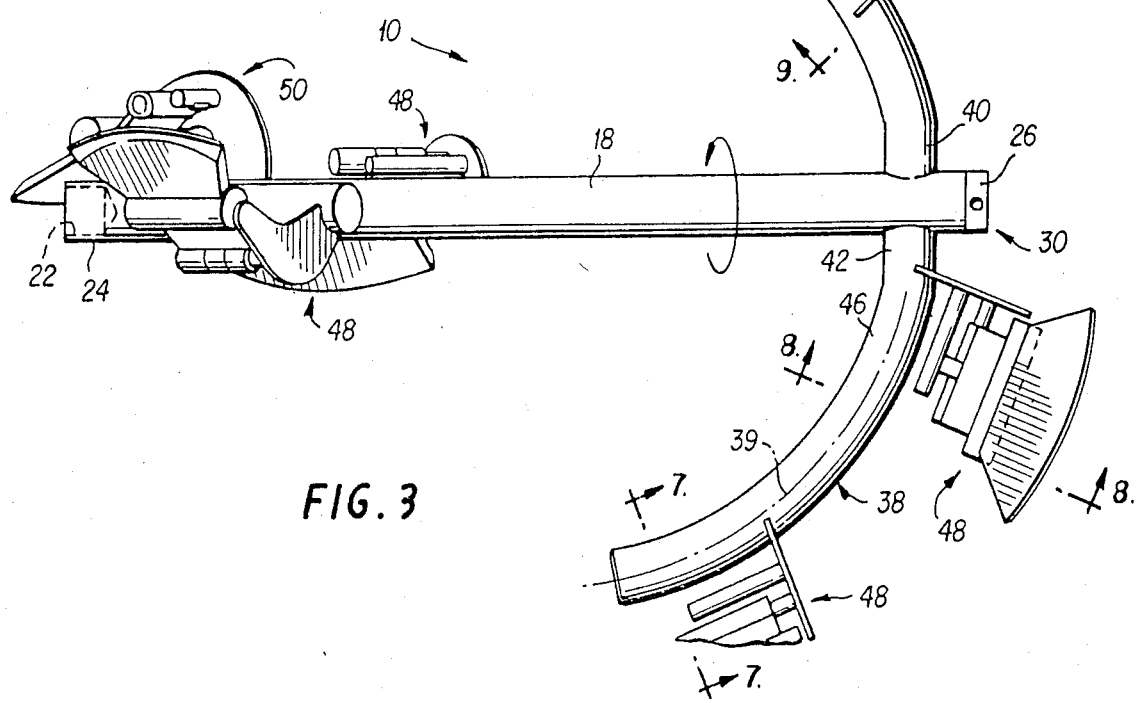
FIG. 3 is an elevational view of the present agitator from a perspective taken after a 90° rotation of the agitator from the position of FIG. 2.
Figure 4:
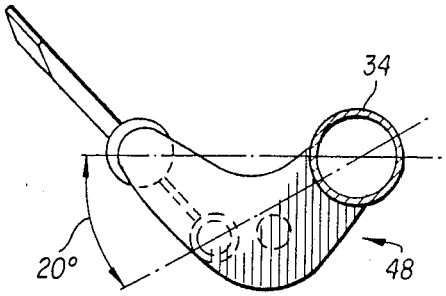
FIGS. 4 through 10 are sectional views taken along respective lines 4—4 through 10—10 of FIGS. 2 and 3 respectively.
Figure 5:
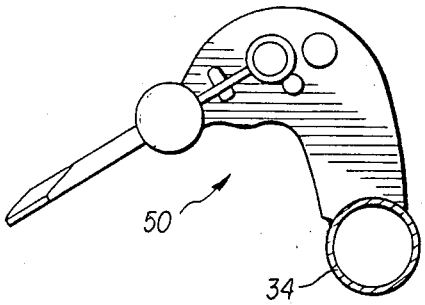
Figure 6:
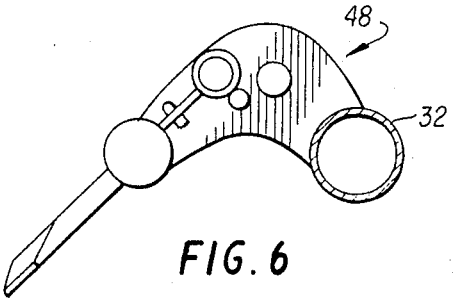
Figure 7:
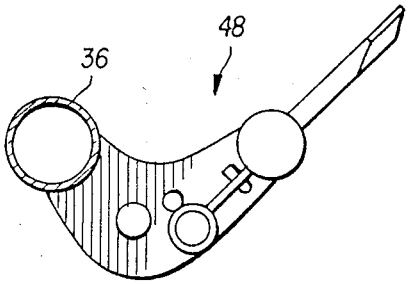
Figure 8:
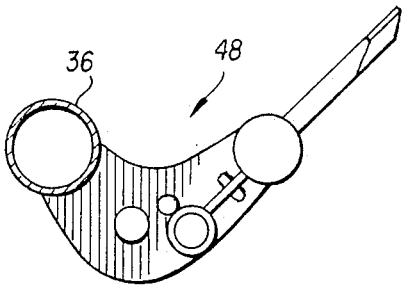
Figure 9:
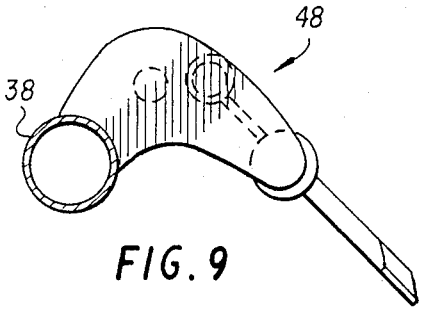
Figure 10:
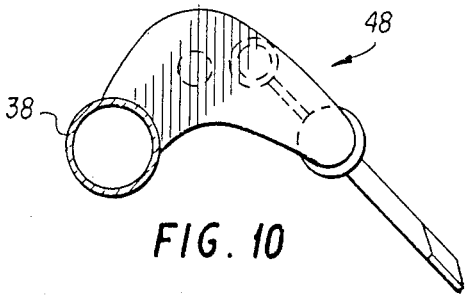

Referring now to FIGS. 1 through 3, the shaft 18 is provided near the recessed end 24 with arcuate segments 32 and 34 which are circular in section and which are attached to the shaft 18 such as by welding. The central arcuate axes 33 and 35 of the arcuate segments 32 and 34 lie substantially in the same plane, that is, a plane taken through the longitudinal axis of the shaft 18 and centrally through the arcuate segments 32 and 34. For purposes of description, the arcuate segments 32 and 34 will thus be said to lie in the same plane. The arcuate segments 32 and 34 essentially comprise segments of a circle having its center located along the longitudinal axis at or near the middle of the shaft 18, the circle having a radius R. The radius R extends to the central arcuate axes 33 and 35. The free end of the segment 32 is advantageously chosen to terminate at an angle of 55°, this angle being taken from the center of the circle with radius R with rays lying respectively along the longitudinal axis of the shaft 18 and along that line from the center of the circle to the free end-of the segment 32. The free end of the segment 34 is similarly chosen to terminate at an angle of 79° with the angle being similarly defined. The angle subtended by the circular arc defined by the segments 32 and 34 including the extension of the central arcuate axes 33 and 35 through the shaft 18 is thus advantageously taken to be 134° although this angle may vary. The arcuate segments 32 and 34 are located at a distance from the end 24 of the shaft 18 which is sufficient to allow mounting of scraping elements as will be later described.

Referring now to FIG. 3, agitator segments 36 and 38 are seen to be mounted on the shaft 18 at locations near the split shaft end 30. In a manner similar to that described above relative to the arcuate segments 32 and 34, the central arcuate axes 37 and 39 of at least portions of the agitator segments 36 and 38 lie in a plane which includes the longitudinal axis of the shaft 18. However, the plane in which the agitator segments 36 and 38 lie is perpendicular to the plane in which the arcuate segments 32 and 34 lie. As is noted in FIG. 3, the arcuate segments 32 and 34 lie in a plane which is perpendicular to the plane of the drawing with the segment 34 being hidden from view by the shaft 18. Since the planes in which the arcuate segments 32 and 34 and the agitator segments 36 and 38 lie are at right angles, the visual effect of the agitator 10 is that of a "double anchor" structure with the "anchors" being rotated 90° to each other.

The free ends of the agitator segments 36 and 38 respectively terminate at angles of 103° and 80°, the angles being defined as described above relative to the arcuate segments 32 and 34. Each agitator segment 36, 38 is substantially circular in cross section and, like the arcuate segments 32, 34 can be of a sectional diameter which is substantially equal to the sectional diameter of the shaft 18. Each agitator segment 36, 38 has a linear segment 40, 42 which attaches to the shaft 18. The agitator segments 36, 38 have respective arc portions 44, 46 which extend from the linear segments 40, 42 to the free ends of the agitator segments 36, 38. The exact relative dimensions of the segments 32, 34, 36, 38 as shown in FIGS. 2 and 3 are preferred since scraping structure which is a part of the agitator 10 can be advantageously mounted to said segments at desired locations. However, these dimensions can vary according to the requirements-of particular situations.

The shaft 18 thus provided with the arcuate segments 32, 34 and the agitator segments 36, 38 provide a framework on which six scraper assemblies 48 and one scraper assembly 50 are mounted in order to scrape the inner walls 16 of the kettle 12. The mounting of the scraper assemblies 48, 50 allow the scraping of the full hemisphere defined by the inner walls 16 of the kettle 12 with an overlap provided by each of the scraper assemblies 48, 50 to ensure full coverage of the inner walls 16. The scraper assemblies 48, 50 are configured and are mounted on the arcuate segments 32, 34 and the agitator segments 36, 38 in a manner which allows continuous adjustability of scraping surfaces to facilitate contact with the inner walls 16 for accommodation of wear, to ensure adequate scraping, and to eliminate the need for periodic adjustment of the scraper assemblies 48, 50 to maintain positive contact between the assemblies 48, 50 and the inner walls 16 of the kettle. Full descriptions of the scraper assemblies 48, 50 are provided hereinafter.

Through use of the shaft mounting structure referred to above as being described in U.S. Pat. No. 4,571,091, the agitator 10 can therefore be quickly mounted within the kettle 12 and removed therefrom without the necessity for using tools. The several sealing arrangements and bearing arrangements described in U.S. Pat. No. 4,571,091 can also be used relative to the mounting of the agitator 10 within the kettle 12. Further, the drive arrangements referred to and described in U.S. Pat. No. 4,571,091 can be used to provide motive power to the present agitator 10. It is to be noted, however, that the present agitator 10 is intended for rotation in a single direction to allow the scraper assemblies 48, 50 to "trail" the direction of rotation of the shaft 18.

Referring now to FIGS. 4 through 10, the scraper assemblies 48, 50 are shown in an order of presentation which is referenced to FIGS. 2 and 3. The angles and orientation at which the scraper assemblies 48, 50 are shown in FIGS. 4 through 10 respectively are further referenced to the respective segments 32, 34, 36, 38 on which the scraper assemblies 48, 50 are mounted. The relative orientation of each of the scraper assemblies 48, 50 can thus be seen in FIGS. 4 through 10 on comparison of the drawings to each other. In this regard, each of the segments 32, 34 are shown in the "planar" orientation of FIG. 3 and each of the segments 36, 38 are shown as similarly illustrated in FIG. 2, that is, the arcuate central axes of the segments 32, 34, 36, 38 lie in planes perpendicular to the plane of the page in which the drawings of FIGS. 4 through 10 lie. A horizontal reference line thus drawn centrally through each of the segments 32, 34, 36, 38 acts in concert with a line drawn through the center of the circular sections of the segments and the pivot axis of each of the assemblies 48, 50 to define an angle at which the scraper assemblies 48, 50 are mounted relative to the respective segments 32, 34, 36, 38. The angle for each of the scraper assemblies 48 is approximately 20° although in differing orientations as shown in the drawings. The scraper assembly 50 is mounted at an angle of approximately 50°.

Figure 11:
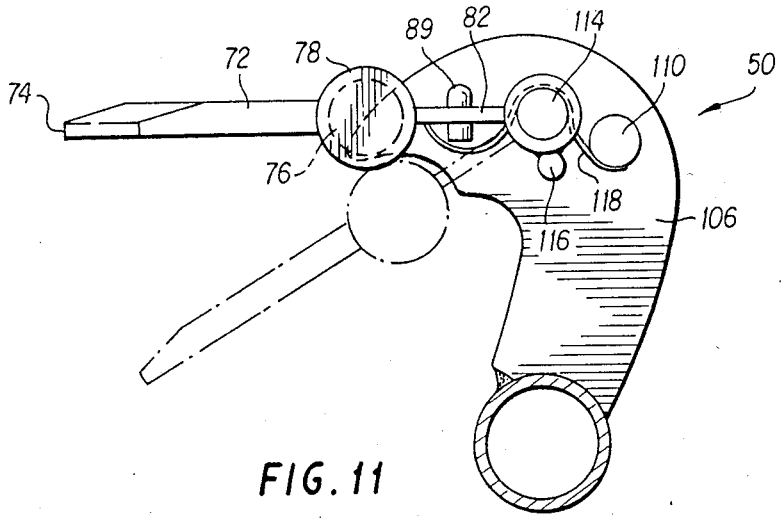
FIG. 11 is a detailed view of the scraper assembly of FIG. 5 illustrating the scraper assembly in elevation.
Figure 12:
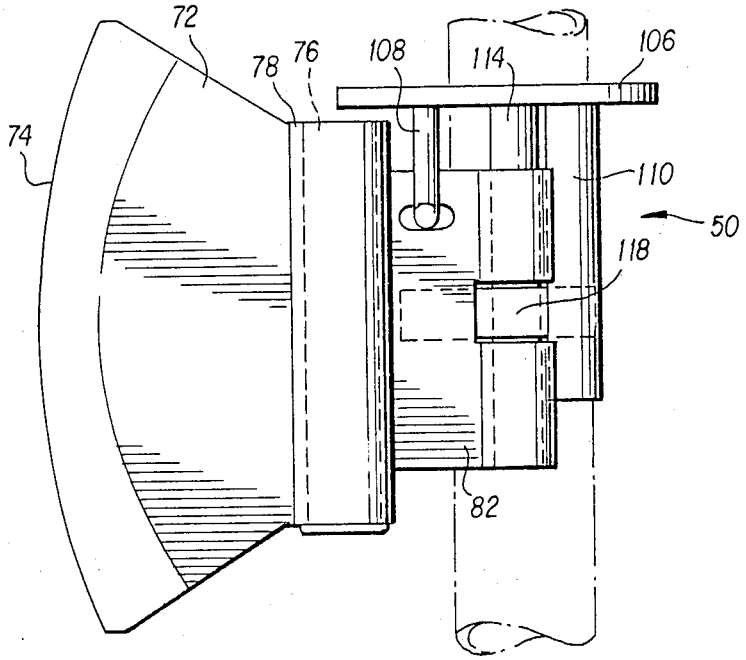
FIG. 12 is a plan view of the scraping assembly of FIG. 11.
Figure 13:
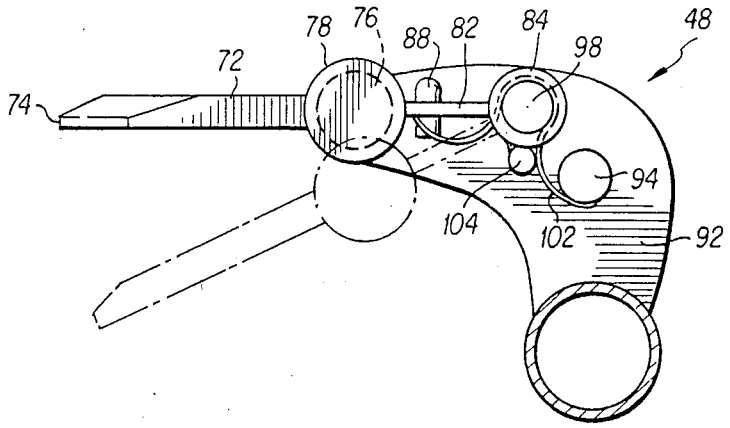
FIG. 13 is an elevational view of any one of the scraper assemblies of FIG. 4 or FIGS. 6 through 10.
Figure 14:
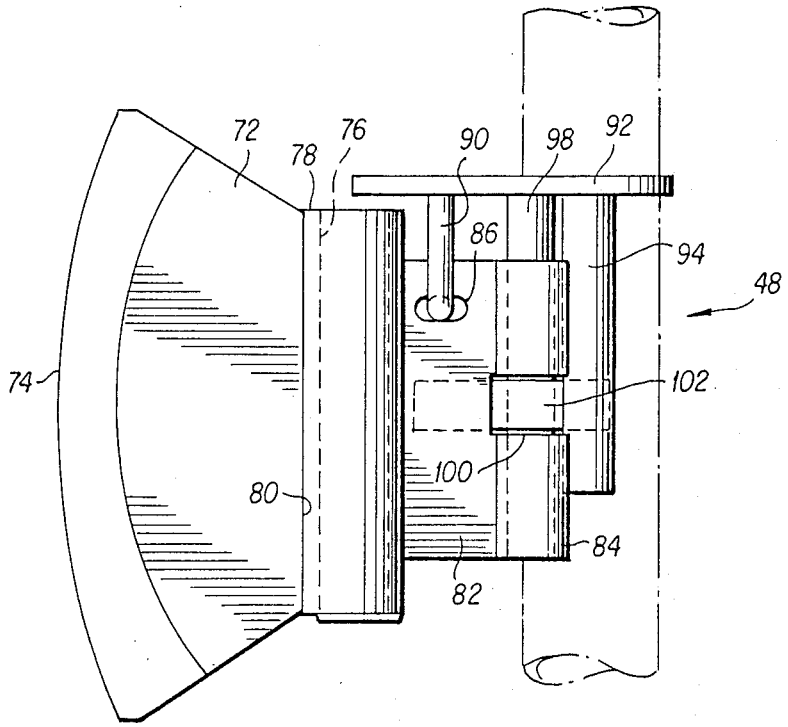
FIG. 14 is a plan view of the scraper assembly of FIG. 13.
Figure 15:
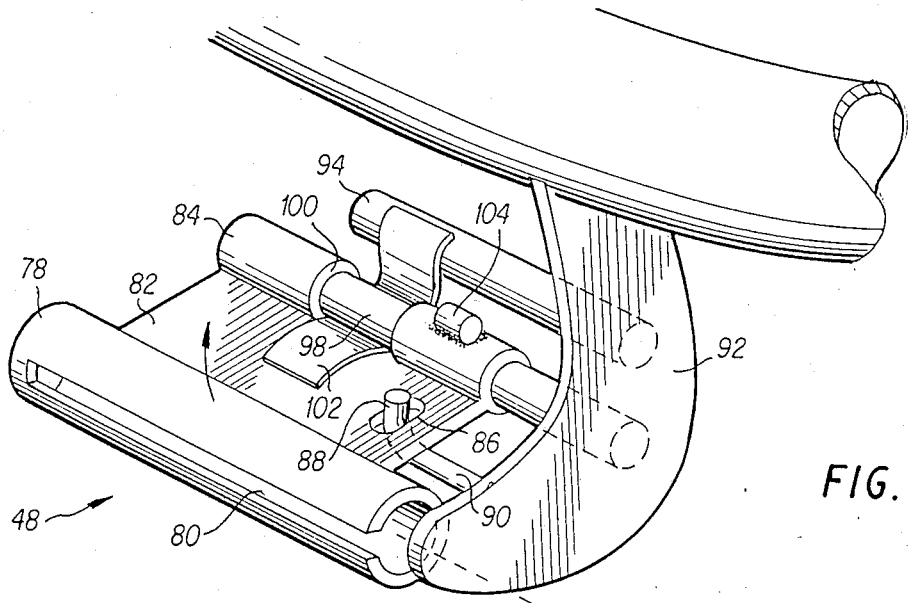
FIG. 15 is a perspective view of a scraper assembly illustrating assembly/disassembly of scraping elements.

Referring now to FIGS. 11 through 14, the scraper assemblies 48, 50 can be seen to each comprise a scraper 72 having an edge 74 which is contoured to fit the arcuate surfaces of the inner walls 16 of the kettle 12. The scrapers 72 are preferably formed of a material such as a tetrafluoroethylene or similar low-friction material. The scraper 72 is seen to taper upwardly from the blunt edge 74 as seen in profile in FIGS. 11 and 13 to a constant body thickness section which terminates along that end opposite the edge 74 in a cylindrical mounting bar 76. As seen in FIGS. 12 and 14, the body portion of each scraper 72 tapers inwardly from the arcuate edge 74 to the bar 76 which yields a fan-shaped appearance as shown in FIG. 15. All of the scrapers 72 used in the scraper assemblies 48 and in the scraper assembly 50 can be substantially identical in structure. However, the scraper assemblies 48 differ in structure from the scraper assembly 50 as is noted in FIGS. 11 through 14 inter alia. FIGS. 13 and 14 illustrate the structure of the scraper assemblies 48 of which six are conveniently used in the agitator 10 such as would be configured for use with a 50 gallon kettle or a kettle of similar size. FIGS. 11 and 12 show the single scraper assembly 50 which is used at the anterior end of the segment 34. The orientations of the scraper assemblies 48 are chosen to allow all portions of the inner walls 16 of the kettle 12 to be scraped during a cooking/heating operation.

The structure of the scraper assemblies 48 is substantially similar to the structure of the scraper assembly 50. Accordingly, one of the scraper assemblies 48 will be described in detail and the dissimilar structural features of the scraper assembly 50 will then be described in order to elucidate the structure of the two assemblies. Referring particularly to FIGS. 13 and 14, the bar 76 of the scraper 72 is seen to be inserted into and carried within a cylindrical housing 78 which is open at one end and which has a slot 80 formed in an outward face to allow the scraper 72 to be mounted by the housing 78. The housing 78 is connected on that surface opposite the slot 80 to a planar bridge 82 which is rectangular in conformation, the bridge 82 further connecting to a pivot cylinder 84, the housing 78, the bridge 82 and the cylinder 84 forming a unitary structure. It is to be understood that the scraper 72 could be formed unitarily with the bridge 82 and the pivot cylinder 84 with all of these elements being formed of the same material as a single molded piece. Such a unitary structure would negate the requirement for the cylindrical housing 78. However, the construction shown in the drawings is preferred due to the ability to form certain portions of the structure from metal, a feature which acts to reduce wear of the structure.

The bridge 82 has a slot 86 formed at one end thereof to receive tip 88 of retainer rod 90 therein, the retainer rod 90 being connected to assembly base plate 92 which connects directly to any one of the arcuate segments 32, 34, or agitator segments 36, 38. The assembly base plate is formed with arcuate and rounded edge surfaces which yield the effect of a "French curve" having a generally U-shaped character. The base plate 92 of each of the assemblies 48 is welded at one end to one of the segments 32, 34 or 36, 38 in a manner which will yield the respective angles and orientations noted in FIGS. 4 through 10. The retainer rod 90 extends at right angles from the base plate 92 to a position surmounting the planar bridge 82, the tip 88 of the retainer rod 90 bending downwardly at a right angle to be received within the slot 86 during a scraping operation. The scraper 72 is thus retained within the scraper assembly 48. Spring retainer rod 94 and pivot rod 98 also extend at right angles from the base plate 92, the pivot rod 98 being received within the pivot cylinder 84 to form a pivot axis about which the scraper 72 and its mounting structure pivots. The pivot cylinder 84 is also formed medially of its length with a substantially full surface cutout portion 100, the cutout portion 100 allowing receipt of a double curve flat spring 102 over the pivot rod 98 and under the spring retention rod 94. The spring 102 exerts a constant tension on-the bridge 82 to maintain the scraper 72 under a tension which forces the scraper into a desired contacting relation with the inner walls 16 of the kettle 12. Through this constant tension, a continuous adjustment occurs which accommodates wear of the edge 74 of the scraper 72. Further, this continuous adjustment effected by the constant tension of the spring 102 accommodates wear of any other portion of the assembly 48 as well as wear of the walls 16 of the kettle, obstructions, etc. A stop 104 is mounted on the pivot cylinder 84 to limit inward pivoting movement of the scraper 72 and associated mounting structure. The scraper 72 and its associated mounting structure can therefore only pivot within an arc essentially defined by the stops provided by the rod 90 and the stop 104.

The scraper 72 and its associated mounting structure can be removed from its assembled condition with the base plate 92 and associated mounting structure by displacing the scraper 72 in a downward arc about the pivot rod 98 as seen in FIG. 11 such that the tip 88 of the retainer rod 90 is displaced from the slot 86. The pivot cylinder 84 can then be displaced away from the base plate 92 to disassemble the scraper 72 and the mounting structure comprised of the housing 78, bridge 82 and pivot cylinder 84 from the base plate 92. The spring 102 also moves from the pivot rod 98 on removal of the scraper 72 and its associated mounting structure. Accordingly, the scraper 72, the spring 102, and the mounting structure thus disassembled can be readily cleaned. Of importance is the fact that the scraper assembly 48 can be disassembled without the use of tools. The scraper assemblies 48 can be reassembled by reversing the steps of the disassembly process.

Referring now to FIGS. 11 and 12, it is seen that the structure of the scraper assembly 50 is similar to that of the scraper assemblies 48. However, base plate 106 is of a different conformation with that portion of the base plate 106 which connects to the segment 32 being larger, the base plate 106 itself being substantially L-shaped in conformation. The base plate 106 is provided with a retainer rod 108, spring retention rod 110, and a pivot rod 114 which function in the manner of the corresponding elements of the scraper assembly 48. However, the elements 108, 110 and 114 are positioned in different locations of the base plate 106 to accommodate the functional requirements of the scraper assembly 50. The scraper assembly 50 has a cylindrical housing, bridge and pivot cylinder which can conveniently be identical to elements 78, 82, and 84 of the scraper assembly 48. A stop 116 essentially identical to the stop 104 of the scraper assembly 48 is also mounted on the pivot cylinder 84 of the scraper assembly 50 to function in a manner essentially identical to that of the stops 104 of the scraper assemblies 48. Due to the differing locations of the elements 108, 110 and 114 on the base plate 106, the position of the stop 116 on the pivot cylinder 84 differs in order to allow a desired range of motion of the scrapers 72 and associated structure of the scraper assembly 50 movable with said scrapers 72.

The configuration of base plate 106 and the differing locations of elements 108, 110, and 114 are determined by the short scraping radius involved between assembly 50 and wall 16 of the kettle as can be seen in FIG. 1 where the leading edge 74 is practically touching the toe bearing 20. In such close proximity assembly 50 must be removed in two steps. The scraper is removed from housing 78. The housing 78 and spring 118 are then removed in the same manner as previously described for assembly 48. Thus, the assembly 50 differs from assemblies 48.

The scraper 72 and its associated mounting structure such as is used for the scraper assemblies 48 can also be used with the scraper assembly 50. A spring 118 is used in the scraper assembly 50 and provides a similar function to that of the spring 102. The scraper assembly 50 can be assembled and disassembled in essentially the same manner as has been described above relative to the scraper assembly 48. The scraper assemblies 48 and 50 are thus configured to maintain the edges 74 of the scraper 72 in forced contact with the inner walls 16 of the kettle 12 by means of the springs 102 and 118, thereby to prevent a "burning on" of foodstuffs when food is heated or cooked within the kettle 12. The scraper assemblies 48 and 50 act in concert with segments 32, 34 and 36, 38 to thoroughly mix foods heated within the kettle 12 as well as to provide a scraping function without damaging shear-sensitive food materials even when the food materials are cooked in small batches or are brought into repeated contact with either an open or closed drain valve 120 (as seen in FIG. 1) as can be provided in the kettle 12 for convenience of removing food materials therefrom on completion of a mixing and/or cooking process.

A perspective view of one of the scraper assemblies 48 is shown in FIG. 15 for further illustration of the structure, the drawing illustrating the arcuate movement of the associated cylindrical housing 78, bridge 82 and pivot cylinder 84 to allow assembly and disassembly as noted herein.

Figure 17:
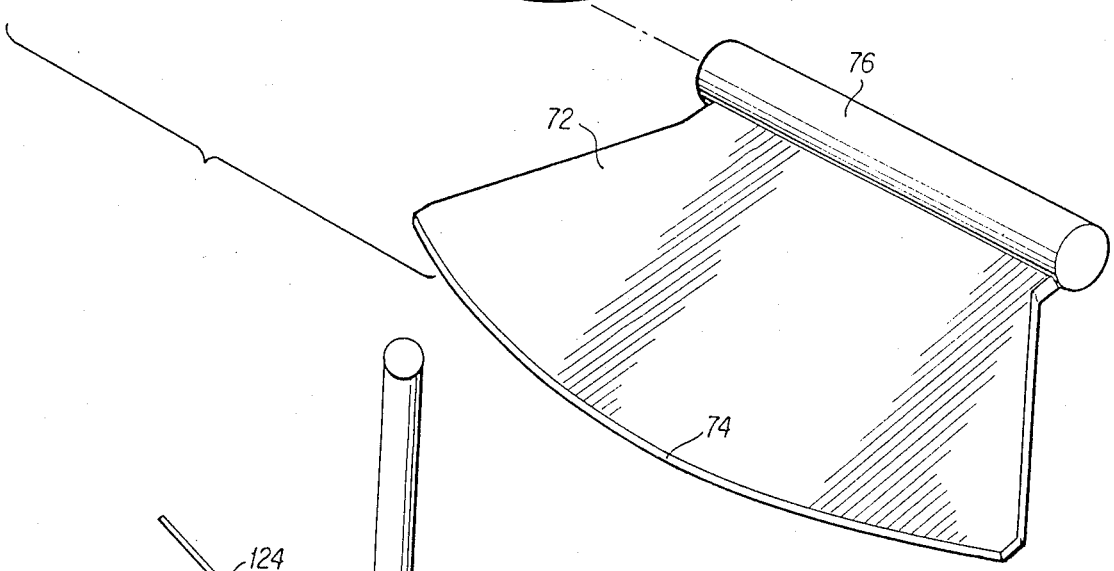
FIG. 17 is a section taken along line 17—17 of FIG. 16.
Figure 17:
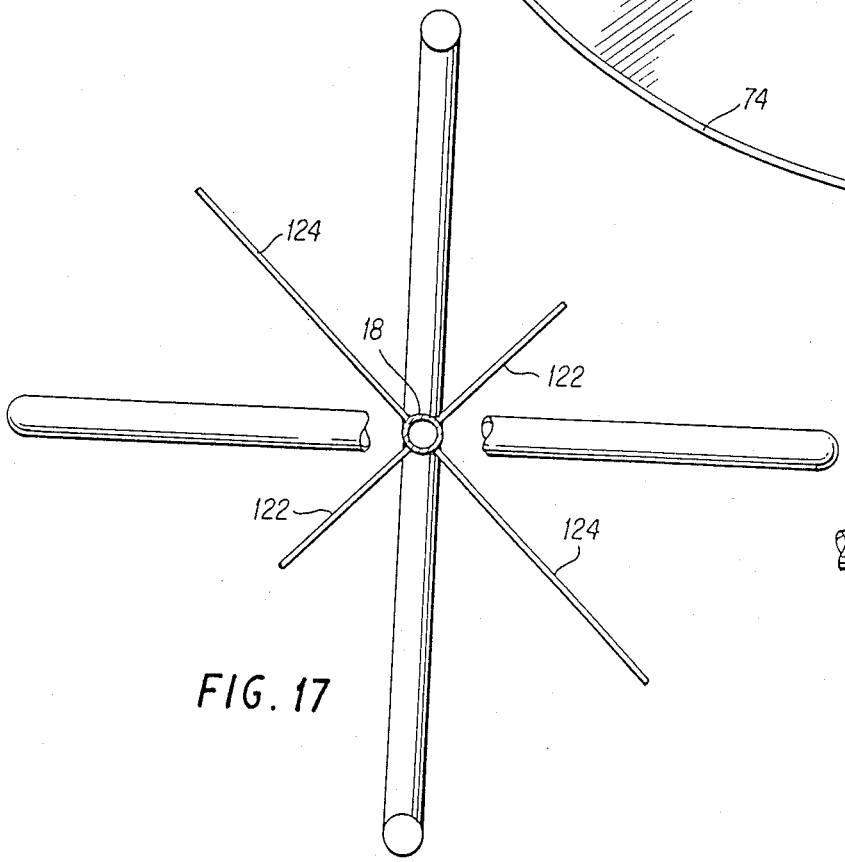
Figure 18:
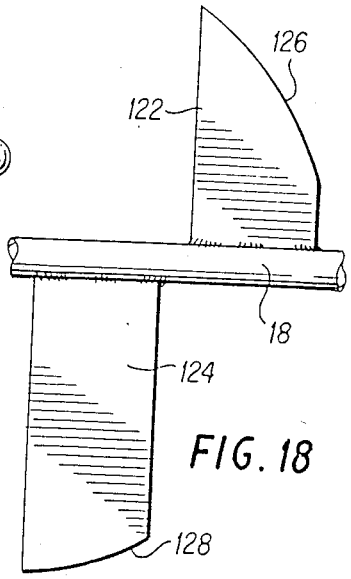
FIG. 18 is a detailed elevational view illustrating the respective conformation of the paddle elements.
Figure 16:
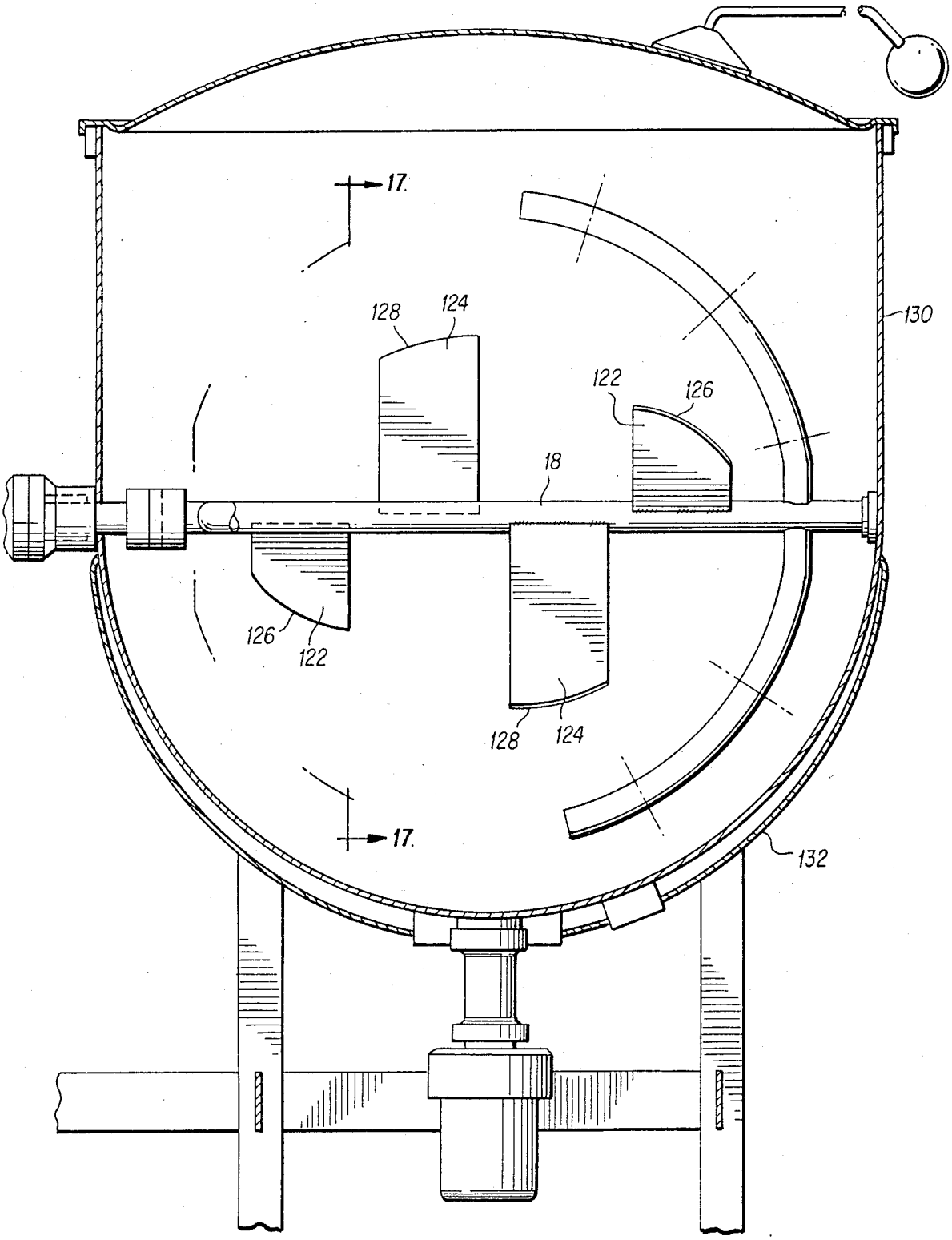
FIG. 16 is an elevational view in partial section of a further embodiment of the present agitator having internal paddle elements and being shown mounted within a kettle.

As seen in FIGS. 16 and 18, a further embodiment of the invention takes the form of the agitator 10 described above with the further provision of mixing blades 122 and 124 mounted to the rotary shaft 18 at positions along the shaft 18 and interiorly of the segments 32, 34, 36 and 38. The mixing blades 122 and 124 are substantially planar in conformation and are substantially rectangular but with arcuate outer edges 126 and 128 respectively. The mixing blades 122 are located more near the ends of the shaft 18 and in proximity to respective segments 32, 34, 36, 38. One each of the blades 122 are mounted at opposite ends of the shaft 18 and, as best seen in FIG. 17, lie in a plane which includes the longitudinal axis of the shaft 18. In other words, the mixing blades 122 are mounted to the shaft 18 in an angular relation of 180°. The mixing blades 122 are of a reduced length relative to the length of the mixing blades 124. In essence, the blades 122 are shorter to allow spacing relative to the segments. Due to the arc of the segments, the mixing blades 124 are chosen to have a greater length since the blades 124 are mounted at central locations along the shaft 18, the central mounting locations allowing greater blade length while still maintaining a desired spacing between said blades 24 and the segments. The mixing blades 124, as best seen in FIG. 17, lie in a plane which also includes the longitudinal axis of the shaft 18, the plane in which the blades 124 lie being perpendicular to the plane in which the blades 122 lie. The blades 124 are thus disposed at an angle 180° relative to each other. As best seen in FIG. 16, the blades 124 are disposed near the center of the shaft 18 near the midpoint thereof.

Referring again to FIG. 17, the mixing blades 122 and 124 are further seen to be preferably arranged such that the planes in which the respective pairs of blades 122 and 124 lie are offset 45° from the planes in which the segments 32, 34, 36 and 38 respectively lie. Due to the fact that the mixing blades 122 and 124 do not lie in the plane of the drawing of FIG. 16, FIG. 18 is provided in order to show the relative dimensions of the blades 122 and 124 and the arcuate contours of the respective outer edges 126 and 128. The contours of the edges 126 and 128 are also chosen to generally conform to the arcuate contours of the segments.

The agitator of FIGS. 16 through 18 is seen to be mounted within a kettle 130 which has a steam jacket 132, this structure being conventional. The mounting of the agitator within the kettle 130 is conventional as is described in U.S. Pat. No. 4,571,091 as referred to above. The agitator of FIG. 16 is provided with the mixing blades 122 and 124 in order to assist in the mixing of relatively viscous or heavy food materials which are to be processed within the kettle 130. While the drawing shows an agitator employed with a kettle which is of a size to accommodate a volume of approximately 50 gallons, it is to be understood that the agitators of the invention can be configured for use in larger kettles. In such situations, both a greater number of scraper assemblies only or scraper assemblies and mixing paddles can be employed. In a similar sense, it is to be understood that the agitators of the invention can be configured other than as explicitly described herein yet remain within the intended scope of the invention. It will be apparent to those skilled in the art that, given the above teachings, variations in structure are possible and that the scope of the invention is defined appropriately by the recitations of the appended claims.

What is claimed is:

1. In combination with an agitator mounted for rotation within a container within which materials are being mixed, apparatus mounted on the agitator for scraping walls of the container, comprising:

scraper means positioned in scraping relation with at least portions of the walls of the container for preventing adhesion of the materials to said walls;

mounting means carried by the agitator and carrying the scraper means for mounting the scraper means for pivotal motion relative to the agitator, the mounting means comprising a pivot rod and a base plate, the base plate being planar in conformation and being joined to the agitator and extending outwardly therefrom, the pivot rod being attached to the base plate and extending perpendicularly therefrom, the scraper means pivoting about the pivot rod; and, adjusting means carried by the agitator for constantly adjusting the position of the scraper means to accommodate surface contours of the walls and to accommodate surface wear of at least portions of the scraper means in order to maintain the scraper means in scraping relation with said walls on rotation of the agitator, the adjusting means comprising retainer means spaced from the mounting means and carried by the agitator for providing a surface against which a force can be directed, the retainer means comprising a spring retainer rod mounted to the base plate of the mounting means and extending perpendicularly therefrom and parallel to and spaced from the pivot rod, and a spring having first and second end portions and a medial portion, the medial portion of the spring being supported by the mounting means and the first and second end portions respectively biasing against the scraper means and the retainer means, the spring being a double curve flat spring with the medial portion thereof being arcuate and fitting about the pivot rod, the first end portion of the spring biasing against the scraper means and the second end portion of the spring being arcuate and fitting about and biasing against the spring retainer rod, the spring thereby exerting a bias on the scraper means to force the scraper means into scraping relation with the walls of the container and to hold the scraper means under tension.

2. The combination of claim 1 and further comprising:

stop means carried by the agitator for limiting the pivotal motion of the scraper means on the mounting means to a predetermined arcuate angle.

3. The combination of claim 1 and further comprising:

means carried by the agitator for releasably holding the scraper means on the mounting means.

4. The combination of claim 1 and further comprising:

releasing means mounted to the base plate for releasably holding the scraper means on the pivot rod.

5. The combination of claim 4 wherein the scraper means has a slot formed therein and the releasing means comprises a retainer rod mounted on the base plate and extending perpendicularly therefrom, the retainer rod having a tip portion which is disposed at an angle relative to the longitudinal axis of the retainer rod, the tip portion extending into the slot formed in the scraper means on pivoting of the scraper means toward the retainer rod.

6. The combination of claim 1 wherein the scraper means comprise:

a scraper element having an edge portion contoured to fit the contours of the portions of the walls which are scraped by the scraper element, the scraper element having a body portion including a bar element; and, a scraper mounting element formed of a planar body portion having a scraper mounting housing at one end of said body portion, the scraper mounting housing being open at one end and having a slot extending along a side thereof opposite the connection of the scraper mounting housing to the body portion, the scraper mounting housing receiving the bar element of the scraper element therewithin, portions of the scraper element including the edge portion extending externally of the scraper mounting housing through the slot, the scraper mounting element further having a pivot housing at an opposite end of the body portion, the pivot housing receiving the pivot rod therewithin, the scraper means pivoting on the pivot rod, the pivot housing having a medial cut-out portion exposing a medial portion of the pivot rod, the arcuate medial portion of the double curve flat spring being received within the cut-out portion of the pivot housing to fit about the pivot rod, the scraper mounting element thereby mounting the scraper element for pivotal movement about the pivot rod under tension from the spring.

7. The combination of claim 6 wherein the container walls are arcuate and the edge portion of the scraper element is arcuate to conform to the shape of the container walls.

8. The combination of claim 6 wherein the scraper element is formed of polytetrafluoroethylene.

* * * * *